United States Patent [19]

Dutt

[11] Patent Number: 4,946,731

[45] Date of Patent: Aug. 7, 1990

[54] CONSTRUCTION FOR AN EXTENDED NIP PRESS BELT

[75] Inventor: William H. Dutt, Rensselaer, N.Y.

[73] Assignee: Albany International Corp., Albany, N.Y.

[21] Appl. No.: 413,788

[22] Filed: Sep. 28, 1989

[51] Int. Cl.[5] ..... B32B 3/28; F16G 1/00

[52] U.S. Cl. ..... 428/156; 428/167; 428/172; 428/245; 428/247; 428/252; 428/289; 428/332; 428/359; 428/361; 428/375; 156/137; 156/140; 162/358

[58] Field of Search ..... 156/137, 138, 139, 140, 156/141; 428/107, 141, 156, 167, 172, 174, 179, 188, 192, 196, 235, 245, 260, 262, 295, 302, 159, 171, 160, 166, 175, 168, 240, 247, 252, 255, 283, 402, 407, 265, 283, 289, 290, 359, 360, 361, 365, 375, 392, 396, 397, 220, 223, 332, 339; 162/358, DIG. 1, 360.1, 362; 100/151, 153; 427/176, 210, 228

[56] References Cited

U.S. PATENT DOCUMENTS

| | | | |
|---|---|---|---|
| 3,656,360 | 4/1972 | Fix | 156/140 |
| 4,559,258 | 12/1985 | Kiuchi | 428/166 |
| 4,643,916 | 2/1987 | Kiuchi | 156/137 |

FOREIGN PATENT DOCUMENTS 1190779 7/1985 Canada .

*Primary Examiner*—Ellis P. Robinson
*Assistant Examiner*—Donald J. Loney
*Attorney, Agent, or Firm*—Kane, Dalsimer, Sullivan, Kurucz, Levy, Eisele & Richard

[57] ABSTRACT

A belt for use on an extended nip press for dewatering a fibrous web is shown. The belt includes a base fabric having machine-direction and cross-machine direction yarns and takes the form of an endless loop. At least one of the machine-direction and cross-machine direction yarns is a spun yarns of staple fibers. The base fabric is completely coated and impregnated with a polymeric resin, such as polyurethane, to render it impervious to liquids, especially lubricating oil. The inner surface of the resulting belt slides over the arcuate pressure shoe component of the extended nip press during its operation. The outer surface of the belt is provided with grooves separated by land areas which together define channels for water pressed from the fibrous web in the press nip. The land areas are anchored to the belt by means of staple fibers from the spun yarns embedded in the coating and are not susceptible to delamination.

10 Claims, 2 Drawing Sheets

CONSTRUCTION FOR AN EXTENDED NIP PRESS BELT

BACKGROUND OF THE INVENTION

1. Field of the Invention

The present invention relates to mechanisms for extracting water from a web of material, and more particularly from a fibrous web being processed into a paper product on a papermaking machine. Specifically, the present invention is an impermeable belt designed for use in conjunction with an extended nip press on a papermaking machine.

2. Description of the Prior Art

During the papermaking process, a fibrous web is formed on a forming wire by depositing a fibrous slurry thereon. A large amount of water is drained from the slurry during this process, after which the newly formed web proceeds to a press section. The press section includes a series of press nips, in which the fibrous web is subjected to compressive forces designed to remove water therefrom. The web finally proceeds to a drying section which includes heated dryer drums around which the web is directed. The heated dryer drums reduce the water content of the web to a desirable level through evaporation.

Rising energy costs have made it increasingly desirable to remove as much water as possible from the web prior to its entering the dryer section. The dryer drums are often heated from within by steam and related costs can be substantial, especially when a large amount of water needs to be removed from the web.

Traditionally, press sections have included a series of nips formed by pairs of adjacent cylindrical press rollers. Recently, the use of extended press nips has been found to be advantageous over the use of nips formed by pairs of adjacent rollers. The longer the web can be subjected to pressure in the nip, the more water can be removed there, and, consequently, the less will remain to be removed through evaporation in the dryer section.

The present invention relates to extended nip presses of the shoe type. In this variety of extended nip press, the nip is formed between a cylindrical press roller and an arcuate pressure shoe. The latter has a cylindrically concave surface having a radius of curvature close to that of the cylindrical press roller. When roller and shoe are bought into close physical proximity, a nip is formed which can be five to ten times longer in the machine direction than one formed between two press rollers. This increases the so-called dwell time of the fibrous web in the extended nip while maintaining the same level of pressure per square inch pressing force used in a two-roller press. The result of this new extended nip technology has been a dramatic increase in dewatering of the fibrous web in the extended nip when compared to conventional nips on paper machines.

An extended nip press of the shoe type requires a special belt, such as that shown in Canadian Patent No. 1,188,556. This belt is designed to protect the press fabric supporting, carrying, and dewatering the fibrous web from the accelerated wear that would result from direct, sliding contact over the stationary pressure shoe. Such a belt must be made with a smooth impervious surface that rides, or slides, over the stationary shoe on a lubricating film of oil. The belt moves through the nip at roughly the same speed as the press fabric thereby subjecting the press fabric to minimal amounts of rubbing against stationary components.

The normal configuration for an extended nip press involves the use of two press fabrics. The components in the nip can be listed in the following sequence: a grooved cylindrical press roller, a first press fabric, the fibrous web or nascent paper sheet, a second press fabric, the special belt, the lubricating film, and the arcuate pressure shoe.

All of the extended nip presses currently in commercial operation are of the above configuration. However, this so-called double-felted extended nip press is limited to certain types of paper grades. To expand the application of the extended nip press to finer paper grades and newsprint, it will be necessary to develop a single-felted extended nip press.

In a single-felted extended nip press, the components in the nip would be listed in the following sequence: a smooth cylindrical press roller, the fibrous web or nascent paper sheet, the press fabric, the special belt, the lubricating film, and the arcuate pressure shoe.

In the double-felted extended nip press, the water pressed from the fibrous web can pass into either of the two press fabrics, as well as into the grooves provided in the cylindrical press roller. In the single-felted extended nip press, two of these sinks for water storage have been eliminated. There is only one felt and, because the fibrous web contacts the cylindrical press roller directly, this roller must have a smooth surface. Clearly, this loss of temporary water storage space must be replaced if a single-felted extended nip press is ever to achieve widespread use. It is absolutely mandatory that voids be provided in the nip of the press, so that water pressed from the paper sheet in a single-felted extended nip press will have a place to be stored.

Two approaches have been taken to achieve a satisfactory solution of this problem. Canadian Patent No. 1,190,779 shows an extended nip press belt having voids on the felt side. These voids arise from the weave pattern of the base fabric and the absence of impregnation on the felt side of the belt, and provide a place into which liquid can be transferred during passage of the fibrous web, press fabric, and special belt through the nip.

The other approach is represented by U.S. Pat. No. 4,559,258 and 4,643,916. These show an extended nip press belt having grooves on the felt side to store water pressed from the fibrous web.

While these two approaches were directed primarily toward achieving a solution to the water-removal problem in a single-felted extended nip press, it has been found that use of either belt in a double-felted extended nip press leads to enhanced dewatering.

In practice, however, it has also been found that satisfactory grooved ENP belts cannot be produced for commercial use. All attempts to make this structure to date have resulted in a product which fails due to delamination of grooves, and/or collapse of the grooves. The present invention is a special belt for an extended nip press which would not be susceptible to delamination.

SUMMARY OF THE INVENTION

But for the problems noted above, the special extended nip press belts having grooves cut into a polyurethane-coated surface demonstrate good dewatering capabilities when used on extended nip presses. The present invention is a grooved extended nip press belt which is not susceptible to groove delamination. As such, it can also be viewed as an improvement of the belt shown in Canadian Patent No. 1,190,779, which has exhibited problems in operation because of the difficulty experienced in dewatering the voids on the felt side thereof. The belt of the present invention, having a grooved surface, can be dewatered much more easily.

Accordingly, the present invention is a belt for use on an extended nip press on a papermachine for dewatering a fibrous web being processed into some form of paper product. The belt includes a base fabric having the form of an endless loop, having been woven in that form or closed thereto by means of a seam. The base fabric, having machine-direction yarns and cross-machine direction yarns, includes spun yarns in at least one of these directions. Where the base fabric has a multilayer structure, the spun yarns will at least be found on the outer surface of the endless loop of the base fabric. The spun yarns, in any case, are spun from a plurality of staple fibers.

The belt further includes a coating of a polymeric resin, such as polyurethane. The coating is applied in such a manner as to completely impregnate the structure of the base fabric rendering it impervious to liquids. It should further be smooth and of uniform thickness.

On the outer surface of the coated belt are cut a plurality of grooves, which can, for example, lie in the machine direction or cross-machine direction. The grooves define channels for water pressed from the fibrous web in the extended press nip, and are separated by what may be referred to as land areas. These areas are portions of the coating not cut away to create grooves.

In prior-art extended nip press belts, the land areas delaminate, or peel off, from the base structure because a polymeric resin, such as polyurethane, does not have sufficient strength and adhesion capabilities to withstand the compressive operating conditions in the press nip. In the present invention, this is overcome through the use of the spun yarns in the base fabric on its outer surface, that is, the surface to be grooved. The spun yarns can be used in either the machine-direction, the cross-machine direction, or in both of these directions.

When the polymeric resin coating is applied to the spun yarn side of the base fabric, the plurality of staple fibers of the spun yarn intermix and penetrate into the coating, thereby establishing a reinforcing effect and permitting the coating to be more firmly bound to the base fabric. After grooves have been cut into the outer surface of the coated base fabric, the plurality of staple fibers, on the surfaces of and extending from the spun yarn, which are embedded in the polymeric resin coating, serve to hold the so-called land areas in place during the operation of the belt on the papermachine. The spun yarns, being interwoven into the base fabric, act as anchors for the matrix of fiber and resin which forms the land areas.

The present invention will be particularly described below, with frequent reference made to the accompanying figures.

DETAILED DESCRIPTION OF THE PREFERRED EMBODIMENT

Figure 1:
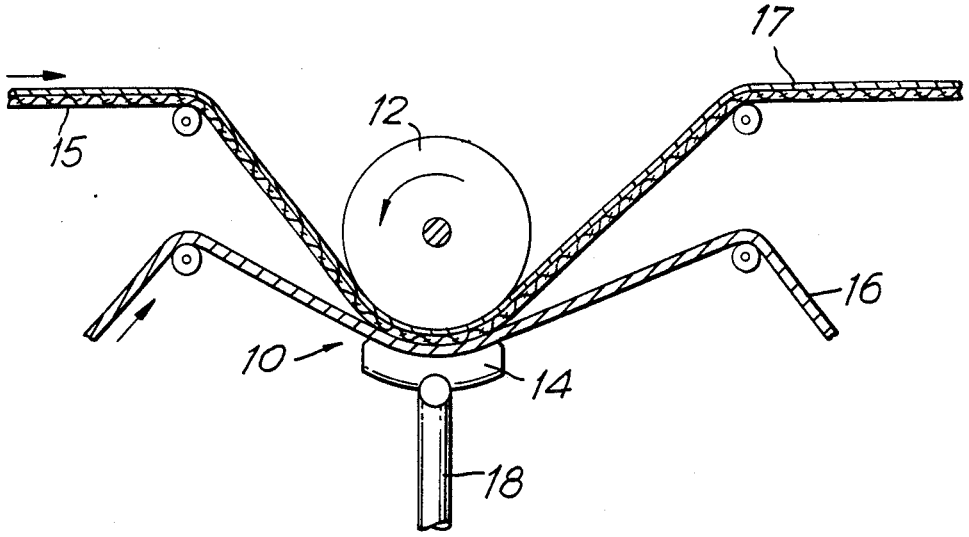
FIG. 1 is a side elevational view of an extended press nip for which the belt of the present invention is designed.
Figure 2:
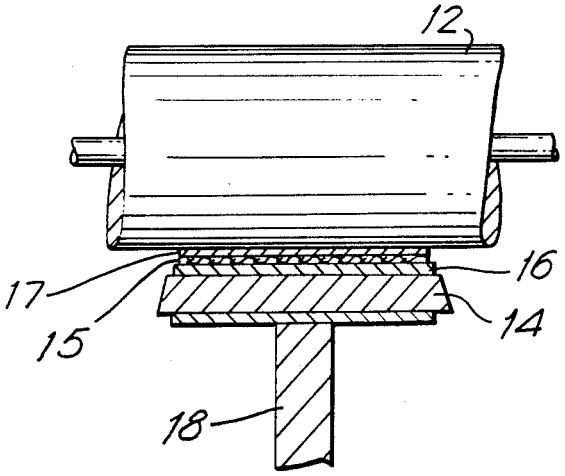
FIG. 2 is a partially sectioned front view of the press nip shown in FIG. 1.

A single-felted extended nip press for dewatering a fibrous web being processed into a paper product on a paper machine is shown in FIGS. 1 and 2. The press nip 10 is defined by a smooth cylindrical press roller 12, an arcuate pressure shoe 14, and a belt 16 of the present invention arranged such that it bears against the surface of the cylindrical press roller 12. The arcuate pressure shoe 14 has about the same radius of curvature as the cylindrical press roller 12. The distance between the cylindrical press roller 12 and the arcuate pressure shoe 14 may be adjusted by means of conventional hydraulic or mechanical apparatus, which is not shown, connected to a rod 18 pivotally secured to the arcuate pressure shoe 14. The rod 18 may also be actuated to apply the desired pressure to the arcuate pressure shoe 14. It will be appreciated that the cylindrical press roller 12 and arcuate pressure shoe 14 described above and shown in FIGS. 1 and 2 are conventional in the art.

Also shown in FIGS. 1 and 2 are a papermaker's wet press fabric 15 and a fibrous web 17 being processed into a paper sheet. The motions of the belt 16, press fabric 15, fibrous web 17, and cylindrical press roller 12 are as indicated by the arrows in FIG. 1.

Figure 3:
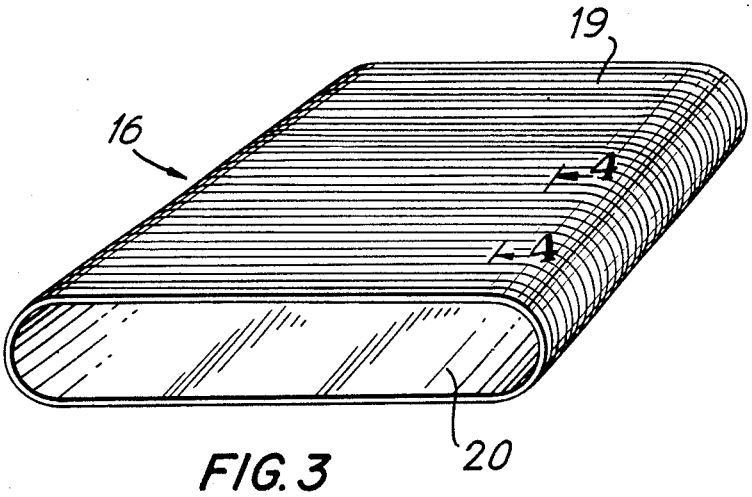
FIG. 3 is a plan view of the belt of the present invention.

A plan view of the belt 16 of the present invention is provided in FIG. 3. It has an outer surface 19 and an inner surface 20. The belt 16 includes a base fabric which takes the form of an endless loop. The base fabric can be produced, or woven, in endless form, or can be produced in flat form, such as by flat weaving, and joined into endless form by a seam. Seaming into endless form should preferably be done before the inner surface of the belt 16 is coated with polymeric resin.

Figure 4:
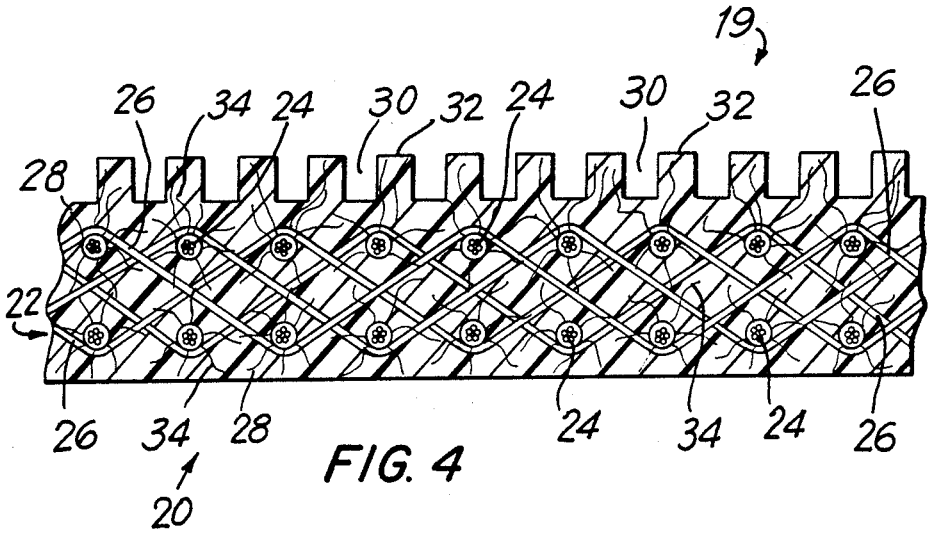
FIG. 4 is a sectional view of the belt of the present invention taken along lines 4—4 in FIG. 3.

One embodiment of the belt 16 is shown in greater detail in FIG. 4, which is a sectional view taken along line 4—4 in FIG. 3. As such, it is a section taken in the cross-machine direction, that is, across the loop of belt 16. The outer surface 19 and the inner surface 20 are as generally indicated. As shown in FIG. 4, the belt 16 comprises a multi-layer woven base fabric 22 of machine-direction yarns 24 and cross-machine direction yarns 26 which has been completely impregnated with a polymeric resin coating 28, such as, for example, polyurethane, to render it impervious to liquids, especially lubricating oil.

The base fabric 22 is sufficiently open to allow the polymeric resin to completely impregnate the structure thereof to eliminate the possibility of undesirable voids forming in the belt 16. Voids are particularly undesirable because they would allow the lubricating oil used between the belt 16 and the arcuate pressure shoe 14 to pass through the belt 16 and contaminate the press fabric 15 and fibrous web 17.

Once the coating 28 has been applied and cured, the outer surface 19 and the inner surface 20 of the belt 16 can be ground smooth, giving the belt 16 a uniform thickness. It is especially important for the inner surface 20 to be so finished so that it will be suited for the lubricated sliding contact over the arcuate pressure shoe 14 in the press nip 10.

The outer side 19 of the belt 16 is then provided with a series of grooves 30 which define channels for handling water pressed from the fibrous web 17 in the press nip 10 As shown in FIG. 4, the grooves 30 are cut in the machine direction, although they could alternatively be made in the cross-machine, or some other, direction. The grooves 30 are separated by so-called land areas 32, which represent those portions of the outer surface 19 of the belt 16 not disturbed during the grooving process.

In the belts 16 of the present invention, there would preferably be six to eight grooves 30 per inch. The depth of the grooves 30 would fall in the approximate range of from 0.060 inch to 0.100 inch; the width of the grooves 30 would fall in the approximate range of from 0.020 inch to 0.040 inch.

Prior art belts of the present type have failed because the land areas 32 suffer from the tendency to delaminate under the extreme compressive environment of the press nip 10. In colloquial language, the land areas 32 peel off in long strips, thereby destroying the grooved outer surface 19. In the belt 16 of the present invention, this delamination is overcome by using a spun yarn in either the machine-direction, cross-machine direction, or in both of these directions on the outer surface 19 of the base fabric 22.

A spun yarn will have a plurality of staple fibers, which are fairly short and extremely fine. The surface of a strand of spun yarn will typically be characterized by a certain fuzziness brought about by the ends of individual staple fibers extending therefrom. Staple fibers 34 appear in FIG. 4 extending through the coating 28 of polymeric resin.

As depicted in FIG. 4, the machine-direction yarns 24 are spun yarns giving rise to the staple fibers 34, while the cross-machine direction yarns 26 are monofilament. While the yarns in at least one direction on the outer surface 19 of the base fabric 22 must be spun yarns to provide a belt 16 in accordance with the present invention, spun yarns could be included in other layers of a multi-layer base fabric 22, as shown in FIG. 4, without departing from the scope of the present invention.

The staple fibers 34 extend into and become embedded in the coating 28 of polymeric resin. After grooving, the staple fibers 34 serve to hold the land areas 32 in place during the operation of the belt on the papermachine, The spun yarns being interwoven into the structure of the base fabric 22 further act as anchors for the matrix of fiber and resin which form the land areas 32 between the grooves 30.

As noted above, polyurethane is a polymeric resin suitable for use as a coating 28. In general, any fiber variety compatible with a given polymeric resin can be used to produce the spun yarns required for the practice of the present invention.

In general, the belt 16 of the present invention can be dewatered outside the press nip 10 far more easily that the belt shown in Canadian Patent No. 1,190,779. The mesh on the felt side of the latter tends to trap water; this is not the case with the channels 30 of the present belt 16.

It should be easily understood that modifications to the above would be obvious to anyone skilled in the art without departing from the scope of the appended claims.

What is claimed is:

1. A belt for use in an extended nip press for dewatering a fibrous web, said extended nip press having a cylindrical press roller and an arcuate pressure shoe which together define a nip therebetween, said belt being passed through said nip in conjunction with at least one press felt supporting and carrying said fibrous web to be dewatered between said press felt and said arcuate pressure shoe, said belt having a shoe side and a felt side, said belt comprising:

a base fabric in the form of an endless loop having an inner surface and an outer surface, said base fabric having machine direction and the cross-machine direction yarns, said machine-direction being around said loop and said cross-machine direction being across said loop, wherein at least one of said machine-direction yarns and said cross-machine direction yarns are spun yarns, and wherein said spun yarns are spun from a plurality of staple fibers; and a coating of a polymeric resin on said inner and outer surfaces of said base fabric, said coating impregnating and rendering said base fabric impervious to liquids, said coating being smooth and giving said belt a uniform thickness, wherein a plurality of grooves are cut in said coating on said outer surface of said base fabric, said plurality of grooves defining channels for water pressed from said fibrous web alternating with land areas, said land areas being anchored to said base fabric by said plurality of staple fibers of said spun yarns, so that said land areas will not delaminate from said belt.

2. A belt for use on an extended nip press as claimed in claim 1 wherein said polymeric resin is polyurethane.

3. A belt for use on an extended nip press as claimed in claim 1 wherein said base fabric is a woven fabric, woven from said machine-direction yarns and said cross-machine direction yarns.

4. A belt for use on an extended nip press as claimed in claim 1 wherein said base fabric is a multilayer fabric and wherein said spun yarns are on said outer surface of said base fabric.

5. A belt for use on an extended nip press as claimed in claim 1 wherein said base fabric is a woven multilayer fabric, woven from said machine-direction and said cross-machine direction yarns, and wherein said spun yarns are on said outer surface of said base fabric.

6. A belt for use on an extended nip press as claimed in claim 1 wherein said plurality of grooves are cut in said machine direction around said outer surface of said belt.

7. A belt for use on an extended nip press as claimed in claim 1 wherein said plurality of grooves are cut in said cross-machine direction across said outer surface of said belt.

8. A belt for use on an extended nip press as claimed in claim 1 wherein there are from six to eight said grooves per inch on said felt side of said belt.

9. A belt for use on an extended nip press as claimed in claim 1 wherein said grooves have a depth in the approximate range from 0.060 inch to 0.100 inch.

10. A belt for use on an extended nip press as claimed in claim 1 wherein said grooves have a width in the approximate range from 0.020 inch to 0.030 inch.

* * * * *